US005884488A

United States Patent [19]

Gram et al.

[11] Patent Number: 5,884,488

[45] Date of Patent: Mar. 23, 1999

[54] HIGH PRESSURE FUEL SUPPLY SYSTEM FOR NATURAL GAS VEHICLES

[75] Inventors: Anker Gram, Vancouver; Stephen Duncan Noble, West Vancouver, both of Canada

[73] Assignee: Westport Research Inc., Vancouver, Canada

[21] Appl. No.: 965,969

[22] Filed: Nov. 7, 1997

[51] Int. Cl.[6] ..... F17C 13/00

[52] U.S. Cl. ..... 62/50.6; 417/901

[58] Field of Search ..... 62/50.6; 417/901

[56] References Cited

U.S. PATENT DOCUMENTS

| | | | |
|---|---|---|---|
| 5,127,230 | 7/1992 | Neeser et al. . | |
| 5,163,409 | 11/1992 | Gustafson et al. . | |
| 5,360,139 | 11/1994 | Scherrer | 62/50.6 |
| 5,411,374 | 5/1995 | Gram . | |
| 5,477,690 | 12/1995 | Gram . | |
| 5,533,492 | 7/1996 | Willey et al. . | |
| 5,545,015 | 8/1996 | Goode | 62/50.6 |
| 5,551,488 | 9/1996 | Gram . | |
| 5,566,712 | 10/1996 | White et al. . | |
| 5,575,626 | 11/1996 | Brown et al. . | |

*Primary Examiner*—Ronald Capossela

*Attorney, Agent, or Firm*—McAndrews, Held & Malloy, Ltd.

[57] ABSTRACT

This invention relates to a medium and high pressure liquid natural gas fuel system for internal combustion engines and for other cryogenic systems. A cryogenic pump comprising: (a) a vessel for containing compressed gas and liquid; (b) a first chamber in said vessel with an inlet therein for receiving gas and liquid; (c) a second chamber communicating with said first chamber for receiving and dispelling gas and liquid; (d) a third chamber communicating with said second chamber for receiving and dispelling gas and liquid; (e) a reciprocating means separating said first, second and third chambers from one another and for drawing and compressing gas and liquid in any one of the first, second and third chambers; (f) one-way inlet means for enabling gas and liquid to pass into the first chamber; (g) one-way means between said first and second chambers for enabling gas and liquid to pass from said first chamber to said second chamber; (h) one-way means for enabling gas and liquid to return from the second chamber to the first chamber; (i) one-way means between said second and third chambers for enabling gas and liquid to be passed from said second chamber to said third chamber; and (j) one-way means for enabling gas and liquid to be expelled from said third chamber to the exterior of the vessel. The invention also relates to a single action suction and double action discharge pump which can be readily removed from a confined space.

27 Claims, 6 Drawing Sheets

HIGH PRESSURE FUEL SUPPLY SYSTEM FOR NATURAL GAS VEHICLES

TECHNICAL FIELD

This invention relates to a medium and high pressure liquid natural gas fuel systems for internal combustion engines and for other cryogenic systems.

BACKGROUND

Natural gas has been used as a fuel for piston engine driven vehicles for over fifty years but the drive to improve efficiency and reduce pollution is causing continual change and improvements in the available technology. In the past, natural gas driven vehicles (NGV) were naturally fumigated, that is, natural gas was introduced into the cylinders through the intake manifold, mixed with the intake air and fed into the cylinders at relatively low pressure. The fuel supply system for such an NGV is relatively simple. Fuel is held in and supplied from a liquified natural gas (LNG) vehicle tank with working pressure just above the engine inlet pressure, or from compressed natural gas cylinders (CNG) through regulators which reduce the pressure to the engine inlet pressure.

Compressed natural gas (CNG) is commonly stored at ambient temperatures at pressures up to 3600 psi (24,925 kPa), and is unsuitable for trucks and buses due to the limited operating range and heavy weight of the CNG storage tanks.

On the other hand, liquified natural gas (LNG) is normally stored at temperatures of between about −240° F. and −200° F. (about 150° C. and −130° C.) and at pressures of between about 15 and 100 psig (204 and 790 kPa) in a cryogenic tank, providing an energy density of about four times that of CNG.

However, better efficiency and emissions can be achieved if the natural gas is injected directly into the cylinders under high pressure at the end of the compression stroke of the piston. This requires a fuel supply system which can deliver the natural gas at a pressure of 3000 psig and above. This makes it impossible to deliver the fuel directly from a conventional LNG vehicle tank and it is impractical and uneconomical to build an LNG tank with such a high operating pressure. Equally, it is impossible to deliver the natural gas fuel directly from a conventional CNG tank as the pressure in such a tank is lower than the injection pressure as soon as a small amount of fuel has been withdrawn from the CNG tank. In both cases, a booster pump is required to boost the pressure from storage pressure to injection pressure.

Liquid Natural Gas (LNG) Pump

High pressure cryogenic pumps have been on the market for many years, but it has proven difficult to adapt these pumps to the size and demand of a vehicle pump. In general, cryogenic pumps must have a positive suction pressure. It has therefore been common practice to place the pump directly in the liquid so that the head of the liquid will supply the necessary pressure. The problem with this approach is that it introduces a large heat leak into the LNG storage tank and consequently reduces the holding time of the tank. The holding time is the time it takes for the pressure to reach relief valve set pressure.

Some manufacturers have placed the pump outside the storage tank and have reduced the required suction pressure by using a large first stage suction chamber. The excess LNG which is drawn into such a chamber, over that which can fill a second chamber, is returned to the LNG tank and again, additional heat is introduced into the LNG, which is undesirable.

Another problem with a pumped LNG supply is that it is difficult to remove vapour from the LNG storage tank. With low pressure gas supply systems, this is easily done. If the pressure in the LNG tank is high, fuel is supplied from the vapour phase which will reduce the pressure. If pressure is low, fuel is supplied from the liquid phase. This characteristic of a low pressure system substantially lengthens the holding time, which is very desirable as mentioned above. Extending the holding time cannot be done with conventional LNG pump systems which draw from the liquid phase only and cannot remove vapour.

U.S. Pat. No. 5,411,374, Gram, issued May 2, 1995, and its two divisional patents, 5,477,690, issued Dec. 26, 1995, and 5,551,488, issued Sep. 3, 1996, disclose embodiments of a cryogenic fluid pump system and method of pumping cryogenic fluid. The cryogenic fluid piston pump functions as a stationary dispensing pump, mobile vehicle fuel pump, etc., and can pump vapour and liquid efficiently even at negative feed pressures, thus permitting pump location outside a liquid container. The piston inducts fluid by removing vapour from liquid in an inlet conduit faster than the liquid therein can vapourize by absorbing heat, and moves at essentially constant velocity throughout an induction stroke to generate an essentially steady state induction flow with negligible restriction of flow through an inlet port. The stroke displacement volume is at least two orders of magnitude greater than residual or dead volume remaining in cylinder during stroke changeover, and is greater than the volume of inlet conduit. As a fuel pump, the pump selectively receives cryogenic liquid and vapour from respective conduits communicating with the tank, and pumps cryogenic liquid to satisfy relatively heavy fuel demand of the engine, which, when satisfied, also pumps vapour to reduce vapour pressure in the tank while sometimes satisfying relatively lighter fuel demand.

Prior art cryogenic pumps are typically centrifugal pumps, which are placed either in the liquid inside the storage tank, or below the storage tank in a separate chamber with a large suction line leading from the tank, with both the pump and suction line being well insulated. Because a cryogenic liquid is always at its boiling temperature when stored, any heat leaked into the suction line and any reduction in pressure will cause vapour to be formed. Thus, if the centrifugal pump is placed outside the tank, vapour is formed and the vapour will cause the pump to cavitate and the flow to stop. Consequently, prior art cryogenic pumps require a positive feed pressure to prevent or reduce any tendency to cavitation of the pump. In a stationary system, the positive feed pressure is typically attained by locating the pump several feet, for example, 5–10 feet (about 2–3 meters) below the lowest level of the liquid within the tank, and such installations are usually very costly. On board storage fuel storage systems for vehicles use other ways to provide positive feed pressure. Also, centrifugal pumps cannot easily generate high discharge pressures which are considered necessary to reduce fuelling time.

Reciprocating piston pumps have been used for pumping LNG when high discharge pressures are required, but such pumps also require a positive feed pressure to reduce efficiency losses that can arise with a relatively high speed piston pump. Prior art LNG piston pumps are crankshaft driven at between 200 and 500 RPM with relatively small displacements of approximately 10 cubic inches (164 cu. cms). Such pumps are commonly used for developing high pressures required for filling CNG cylinders and usually have a relatively low delivery capacity of up to about 5 gallons per minute (20 liters per minute). Such pumps are single acting, that is, they have a single chamber in which an induction stroke is followed by a discharge stroke, and thus the inlet flow will be stopped half of the time while the piston executes the discharge stroke. Furthermore, as the piston is driven by a crank shaft which produces quasi-simple harmonic motion, the piston has a velocity which changes constantly throughout its stroke, with 70% of the displacement of the piston taking place during the time of one-half of the cycle, that is, one-half of the stroke, and 30% of the piston displacement occurring in the remaining half cycle time. The variations in speed of the piston are repeated 200–500 times per minute, and generate corresponding pressure pulses in the inlet conduit, which cause the liquid to vapourize and condense rapidly. This results in zero inlet flow unless gravity or an inlet pressure above boiling pressure of the liquid forces the liquid into the pump. In addition, the relatively small displacement of these pumps results in relatively small inlet valves which, when opened, tend to unduly restrict flow through the valves. Thus, such pumps require a positive inlet or feed pressure of about 5 to 10 psig (135 to 170 kPa) at the feed or inlet of the reciprocating pump unless the inlet valve is submerged in the cryogenic liquid in which case the feed pressure can be reduced. Large cryogenic piston pumps, with a capacity of about 40 gallons per minute (150 liters per minute) have been built, but such pumps are designed for very high pressure delivery, require a positive feed pressure and are extremely costly.

SUMMARY OF INVENTION

The invention is directed to a cryogenic pump comprising: (a) a vessel for containing compressed gas and liquid; (b) a first chamber in the vessel with an inlet therein for receiving gas and liquid; (c) a second chamber in the vessel communicating with the first chamber for receiving and dispelling gas and liquid; (d) a third chamber in the vessel communicating with the second chamber for receiving and dispelling gas and liquid; (e) a reciprocating means separating the first, second and third chambers from one another and for drawing and compressing gas and liquid in any one of the first, second and third chambers; (f) first one-way means in the inlet for enabling gas and liquid to pass into the first chamber; (g) second one-way means between the first chamber and the second chamber for enabling gas and liquid to pass from the first chamber to the second chamber; (h) third one-way means for enabling gas and liquid to return from the second chamber the first chamber; (i) fourth one-way means between the second and third chambers for enabling gas and liquid to pass from the second chamber to the third chamber; and (j) fifth one-way means for enabling gas and liquid to be expelled from the third chamber to the exterior of the vessel.

The vessel can be a hollow first cylinder, the reciprocating pumping means can be a piston which can reciprocate longitudinally within the interior of the cylinder, reciprocating means being reciprocally driven by a longitudinally extending shaft connecting the reciprocating means with an exterior reciprocating power source.

The reciprocating piston can have thereon a hollow rod which can extend from a side of the piston opposite the longitudinally extending shaft, the hollow rod reciprocating in a second hollow cylinder which can be positioned in the interior of the first cylinder, the hollow rod connecting the second chamber and the third chamber, the third chamber being located in the interior of the second hollow cylinder. Heat insulation can be positioned between the shaft and the first cylinder and between the first cylinder and the second cylinder, and also on the exterior of the vessel.

The one-way means between the first chamber and the second chamber can be a check valve which can be located in the reciprocating piston, and the one-way means connecting the second chamber with the third chamber can be a check valve which can be located in the hollow rod extending from the reciprocating piston. The one-way means connecting the interior of the third chamber with the exterior of the vessel can be a check valve.

The third one-way means can be a liquid pressure relief check valve which can be located in the reciprocating piston, and can be set to open at a predetermined pressure and thereby enable gas and liquid in the second chamber to return to the first chamber. The reciprocating piston and shaft can be driven by a hydraulic cylinder.

The inlet to the first chamber of the vessel can be connected to a liquified natural gas holding tank by a hollow inlet line, the hollow inlet of the inlet line being located below the surface of liquid in the liquified natural gas holding tank.

The pump can include a hollow gas line which can be connected from a gas vapour region of the liquified natural gas holding tank to the hollow liquid inlet line. A control valve and a metering valve can be located in the hollow gas line connecting the gas vapour region of the liquified natural gas holding tank with the hollow liquid inlet line.

The outlet of the third chamber of the pump can be connected to a vapourizer, which can be sequentially connected to a gas accumulator, which can be sequentially connected to an internal combustion engine.

When the gas pressure in the accumulator drops to a specified level, the control valve can close so that the first chamber of the vessel receives only liquid from the hollow liquid inlet line.

The pump can include a hollow gas line connected between the second chamber of the vessel and the gas vapour region of the liquified natural gas holding tank, the gas line having a control valve therein, the control valve opening under predetermined conditions to enable gas from the second chamber to be transferred to the gas vapour region of the holding tank.

The liquified natural gas holding tank can comprise a sealed inner jacket and a sealed outer jacket, and the space between the inner jacket and the outer jacket can have a heat insulating vacuum therein.

The invention is also directed to a cryogenic pump comprising: (a) a vessel for containing compressed gas and liquid; (b) a sump with an inlet therein for receiving gas and liquid, the sump being connectable to a source of gas and liquid; (c) a first chamber in the vessel communicating with the sump for receiving gas and liquid from the sump; (d) first one-way inlet means between the sump and the first chamber for enabling gas and liquid to pass into the first chamber; (e) a second chamber in the vessel communicating with the first chamber for receiving and dispelling gas and liquid; (f) a reciprocating piston separating the first chamber and the second chamber from one another and for drawing and compressing gas and liquid in any one of the first and second chambers; (g) second one-way means in the reciprocating piston between the first and second chambers for enabling gas and liquid to pass from the first chamber to the second chamber; and (h) means for enabling gas and liquid to be expelled from the second chamber to the exterior of the vessel.

The first and second chambers can be cylindrical and can releasably fit within the sump which can be a hollow cylinder, and can be in longitudinal alignment with one another, the reciprocating pumping means can be a piston which can reciprocate longitudinally within the interior of the first and second cylindrical chambers, the reciprocating piston being reciprocally driven by a longitudinally extending shaft connecting the reciprocating piston with an exterior reciprocating energy source, and the second chamber can be an annular shaped volume between the exterior of the shaft and the interior of the cylindrical vessel.

The second hollow annular volume can be connected to a hollow line which can extend to the exterior of the vessel, opposite to the sump inlet.

The first one-way inlet means can be a check valve. The second one-way means between the first chamber and the second chamber can be a check valve which can be located in the reciprocating piston. The means connecting the second chamber with the exterior of the vessel can be a pipe and a check valve which can be located to the exterior of the pump.

The pump can include a seal between the longitudinally extending shaft and the second chamber, and a passage circumventing the seal for enabling liquid that escapes past the seal to be returned to the sump.

The outer jacket can have therein a region in which the pump can be installed between the inner jacket and the outer jacket. The pump can fit within a sump in the region between the inner jacket and the outer jacket, an inlet from the holding tank to the pump can be connected to the sump within the interior between the inner jacket and the outer jacket, and an outlet from the pump can extend to the exterior of the holding tank.

The pump located between the inner and outer jackets of the holding tank can include an inducer which can contain therein a second reciprocating piston which can be connected to the first reciprocating piston, the second reciprocating piston in the inducer separating the interior of the inducer into third and fourth chambers, the third and fourth chambers being interconnected by a check valve and a relief valve, the third chamber being connected to the first chamber by a check valve, and the fourth chamber being connected to the inlet line from the holding tank by a check valve.

The inlet line to the fourth chamber of the inducer can include a hollow gas vapour line which can connect the inlet line with the gas vapour region of the holding tank, the hollow gas vapour line having therein a restriction which can regulate the flow of gas through the gas vapour inlet line. The first chamber can be at least twice as large in volume as the second chamber.

BRIEF DESCRIPTION OF DRAWINGS

In drawings which illustrate specific embodiments of the invention, but which should not be construed as restricting the spirit or scope of the invention in any way.

DESCRIPTION

Natural gas burning engines can be broadly classified into two classes, namely those having a low pressure fuel system and those having a high pressure fuel system. A low pressure fuel system is defined as a fuel system of an engine which operates on a fuel pressure which is lower than the minimum operating pressure of the tank. In this type of low pressure system, no fuel pump is required and the tank has a vapour conduit which removes vapour from the tank, and a liquid conduit which removes liquid from the tank. Each conduit is controlled by a respective valve, which in turn is controlled by at least one pressure sensor. The engine normally receives fuel through the liquid conduit, except in instances where tank pressure exceeds a specified pressure, for example, about 60 psig (516 kPa), in which case the vapour conduit is opened, so as to release some vapour to the engine, which reduces pressure in the tank, thus enabling continued operation on liquid from the tank. This is a simple system which ensures that tank pressure is kept low by taking fuel in the vapour phase from the tank whenever pressure in the tank is over the specified pressure level.

In contrast, a high pressure fuel system requires a fuel pump which supplies fuel at a pressure of about 3,000 psig (20,771 kPa), depending on fuel system parameters. This is usually accomplished by a small displacement piston pump located inside the vehicle tank with a submerged inlet to ensure a positive feed pressure. Such installation is difficult to install and service, and makes the fuel tank and pump assembly relatively large. Because the pump can only pump liquid, all vapour generated by heat leak and working of the pump will decrease the holding time of the tank by a substantial amount, and result in high fuel loss because the vapour must be vented prior to refuelling the tank. This venting of vapour reduces effective capacity of the vehicle tanks still further, compounding the difficulty of use of LNG in a vehicle tank. To the inventor's knowledge, there is no single pump which can efficiently pump both liquid and vapour, or a mixture of both, and thus a system which can remove and burn vapour in the engine is not available for high pressure fuel systems. Also, conventional piston pumps require a positive pressure at the inlet port, which severely limits location of such pumps, and in particular such pumps cannot be used with a vehicle tank having a conventional "over the top" liquid outlet. Many problems would be solved if a vehicle pump could be developed which could operate with a negative suction pressure which would permit the vehicle pump to be located outside the vehicle tank and placed wherever space is available in the vehicle.

Figure 1:
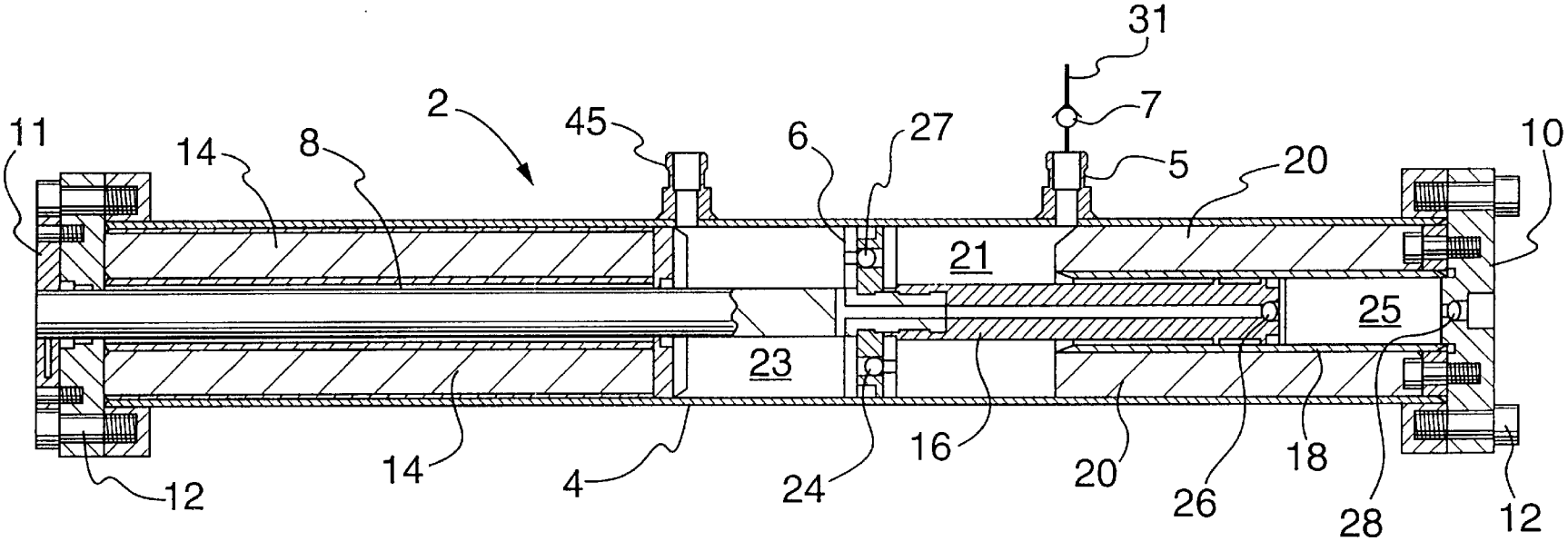
FIG. 1 illustrates a section view of an LNG pump assembly according to the invention.
Figure 2:
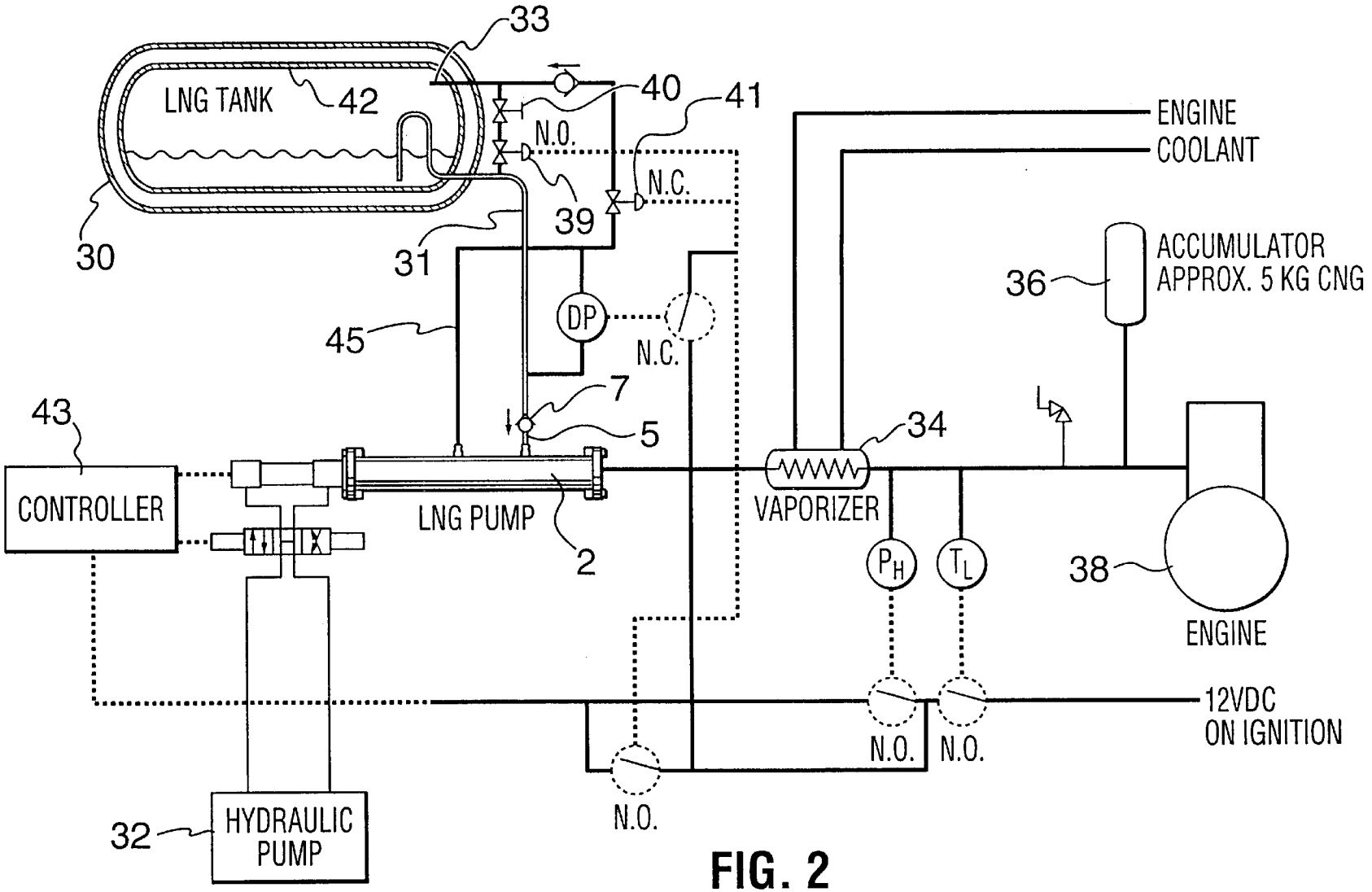
FIG. 2 illustrates a schematic flow diagram of an LNG supply system to an engine according to the invention, where the LNG pump is external to the LNG tank.

Referring to FIGS. 1 and 2, which show respectively a section view of an LNG pump assembly according to the invention, and a schematic flow diagram of an LNG supply system to an engine according to the invention, where the LNG pump is external to the LNG tank, FIG. 1 illustrates a cylindrically shaped pump 2 which holds inside the cylinder 4 a reciprocating piston 6 which is driven by a cylindrical shaft 8 connected to an external driving force. The ends of the cylinder are capped with heads 10 and 11 and bolts 12. Teflon (trade-mark) or similar insulation 14 such as UHMW (a well-known but less expensive cryogenic insulation than Teflon) encloses the shaft 8 and reduces heat loss. The end of piston 6, opposite the shaft 8, has a hollow cylindrical rod 16, which reciprocates inside sleeve 18, which is also insulated with Teflon 20 or similar material. This configuration forms chambers 21, 23 and 25. Check valves 24 and 27 are located in the piston 6, check valve 26 is located in shaft 16 and check valve 28 is in head 10. A one-way check valve 7 is also located in association with inlet 5. While not illustrated in FIG. 1, the exterior of the pump 2 is also insulated to prevent heat transfer into the pump. Lines leading to and from the pump are also insulated, as is conventional in the art.

The first main chamber comprising first and second chambers 21 and 23 separated by piston 6 is about five times larger than the second chamber 25. When the piston 6 retracts to the left, natural gas liquid and vapour is drawn into the first chamber 21 of the cylinder 4 through inlet 5 and a check valve 7 located outside the cylinder 4. When the piston 6 extends to the right, the mixture of liquid and vapour in chamber 21 is moved into second chamber 23 through check valve 24 in piston 6. When the piston 6 retracts again to the left, the liquid and vapour mixture in chamber 23 is compressed and forced into chamber 25 through the passage in the hollow piston rod 16 and check valve 26.

The mixture of liquid and vapour in chamber 21 is at a saturation pressure and temperature during the retracting suction stroke as piston 6 moves to the left. When this mixture is compressed in chamber 23 on the second retraction stroke, the vapour condenses, the total volume is reduced and the liquid is then pushed into chamber 25 through the passage in the hollow rod 16 and check valve 26. If too much liquid is initially drawn into chamber 23, relief valve 27 will open at a given pressure and let the excess fluid move back into chamber 21, thereby returning no liquid to the LNG storage tank 30 under normal operating conditions.

FIG. 2 illustrates a schematic flow diagram of an LNG supply system to an engine according to the invention, where the LNG pump is external to the LNG tank. FIG. 2 illustrates the LNG tank 30, and hydraulic pump 32, which drives the LNG pump 2, the vapourizer 34, accumulator 36 and engine 38. The LNG tank 30 has an inner jacket 42, and a vacuum between the outer jacket and the inner jacket 42, for insulation. The liquid which has entered chamber 25 through check valve 26 will be compressed to the required high pressure when the piston 6 extends to the right. It will then be ejected from chamber 25 through check valve 28 to flow through the vapourizer 34, where the liquid is converted to gas, and into an accumulator 36 as compressed natural gas, where it can be used by the injectors of the engine 38.

In normal operation, the pump 2 will draw a mixture of vapour and liquid from the LNG tank 30. The suction line 31 is connected not only to the liquid phase of the tank, where the end of the line 31 is below the level of the liquid in tank 30, but also to the vapour phase in the upper level of the tank 30, through line 33, a solenoid valve 39 and a metering valve 40. During normal operation, the solenoid valve 39 will be open and the amount of vapour drawn in to line 31 depends on the setting of the metering valve 40. The saturated vapour that is removed from the LNG tank 30 will be compressed and condensed in chamber 23 and further compressed in chamber 25 of LNG pump 2, as explained above in relation to FIG. 1, to the required gas pressure in accumulator 36.

When the solenoid valve 39 is open, the capacity of the pump 2 will be reduced. However, should the pressure in the accumulator 36 get too low, that is, too close to the engine injection pressure because the engine 38 requires more fuel, programmed computer controls in controller 43 will close the solenoid valve 39 and only LNG from the bottom of tank 30 will flow into the pump 2 thereby greatly increasing the fuel capacity of the LNG pump 2.

FIG. 2 shows the pump 2 located outside the LNG tank 30. If the pump 2 is located outside the tank 30, the exterior of the pump is well insulated with conventional insulation material and heat leakage back into the LNG tank 30 is prevented because no flow of the fuel into the LNG tank 30 is possible. Also, the interior of pump 2 is well insulated by insulation 14 and 20. But even so, if the vehicle engine 38 has not been operated for an extended time, such as when the vehicle is parked, the pump 2 may have warmed up relative to the temperature of the liquid in the LNG tank 30. This residual heat in the pump 2 would cause any LNG drawn into the pump 2 to boil and thereby greatly reduce the capacity of the pump 2.

To reduce the cool down time of the pump 2, when it again begins operation, the programmed controls may open a second solenoid valve 41. Opening of valve 41 enables the vapour created by the warm pump 2 to be pumped from chamber 23 through gas line 45 and line 33 into the upper vapour space of the LNG tank 30, thereby increasing the pressure in the tank 30, and thereby forcing more liquid from the bottom of the tank 30 into the pump 2, which will then in turn be cooled down faster than would be the case if solenoid 41 is not opened.

Figure 3:
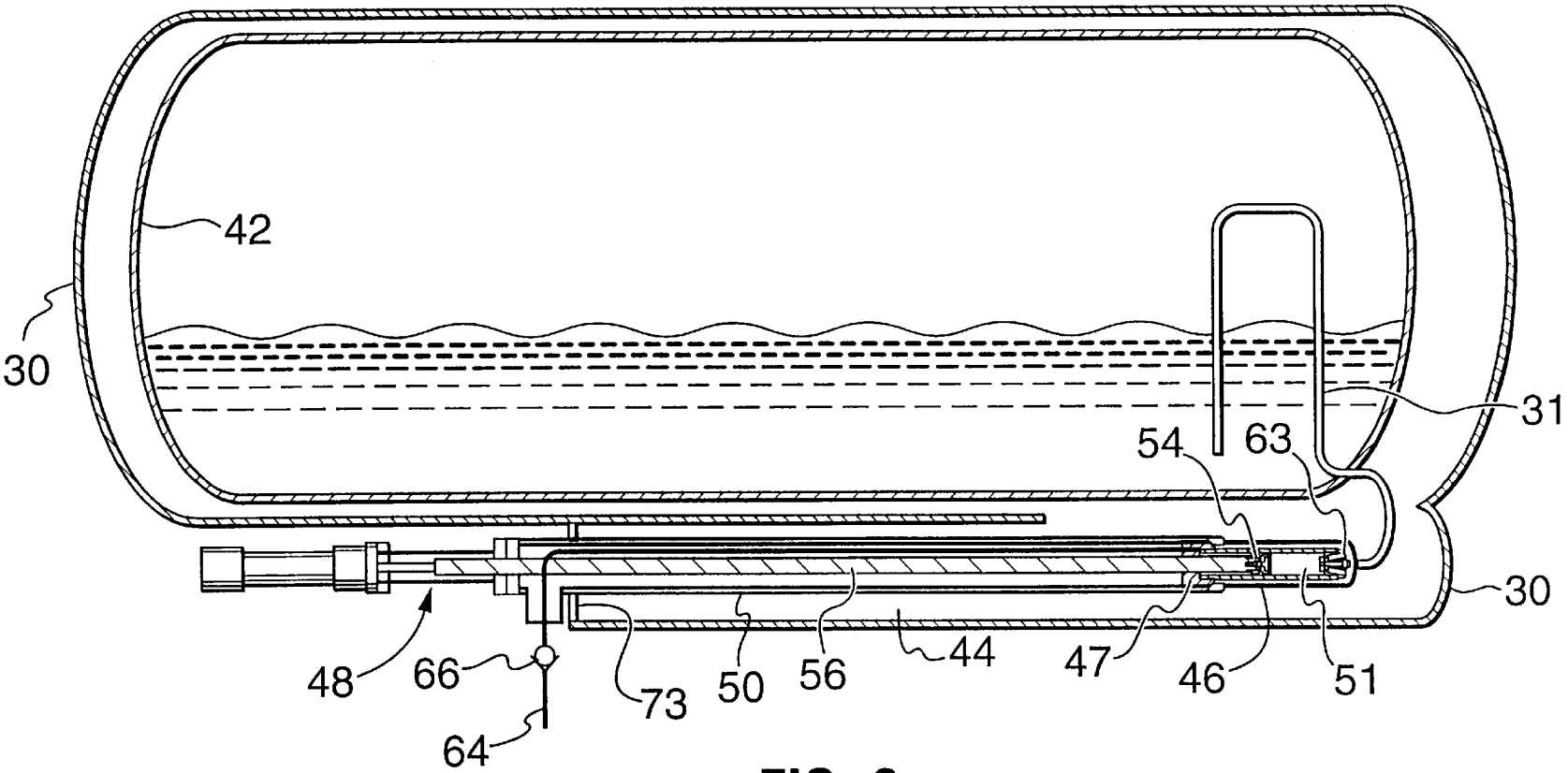
FIG. 3 illustrates a section view of a second embodiment of the invention wherein the LNG pump is built into a sump in the LNG tank.

In another embodiment, the pump 2 may be located in a sump space 44 inside the vacuum space between outer jacket 30 and inner jacket 42 of the LNG tank 30. Such an embodiment is shown in FIG. 3. Greater efficiency and reduced heat leak is gained by locating the pump 2 in the vacuum space of the LNG tank 30. However, to do so, several unique features must be incorporated into a pump 2 designed for this purpose. Also, a sump space 44 must be built into the outer jacket 30.

As explained before, the LNG tank 30 is insulated by a vacuum between outer jacket 30 and inner jacket 42. For maintenance purposes, the pump 2 must be removable from the sump space 44 without disturbing the high vacuum insulating the tank 30. This can be done by permanently connecting the liquid suction line 31 from the inner tank 42 to a small sump 46 which is located in the sump space 44 in the enlargement in the outer jacket 30, and installing the right end of the pump 2 in that sump 46 with a pressure seal 47 which is located so that only the bottom cold end of the pump 2 is surrounded with LNG. The pump 2 can be removed only when the inner tank 42 is empty of LNG. Otherwise, LNG would flow through line 31. The configuration of a built-in pump has the added advantage that no pump cool down procedure is required during start-up. LNG runs freely through line 31 into the sump 46 as soon as pumping is started and when pumping is stopped for an extended time, the LNG in line 31 and sump 46 will be pushed back into the inner tank 42 by vapour pressure thereby reducing the heat loss.

It is usually highly desirable for efficiency to have a double acting pump, because then the pump is working in both directions. But a conventional double acting pump typically has valves at either end which makes such a design unsuitable as a built-in pump. It is difficult to remove the pump 2 unless the sump 46 is very large. This difficulty has been avoided by the unique embodiment of pump 48 illustrated in FIGS. 3 and 4 where the exhaust valve is piped to the exterior end.

Figure 4:
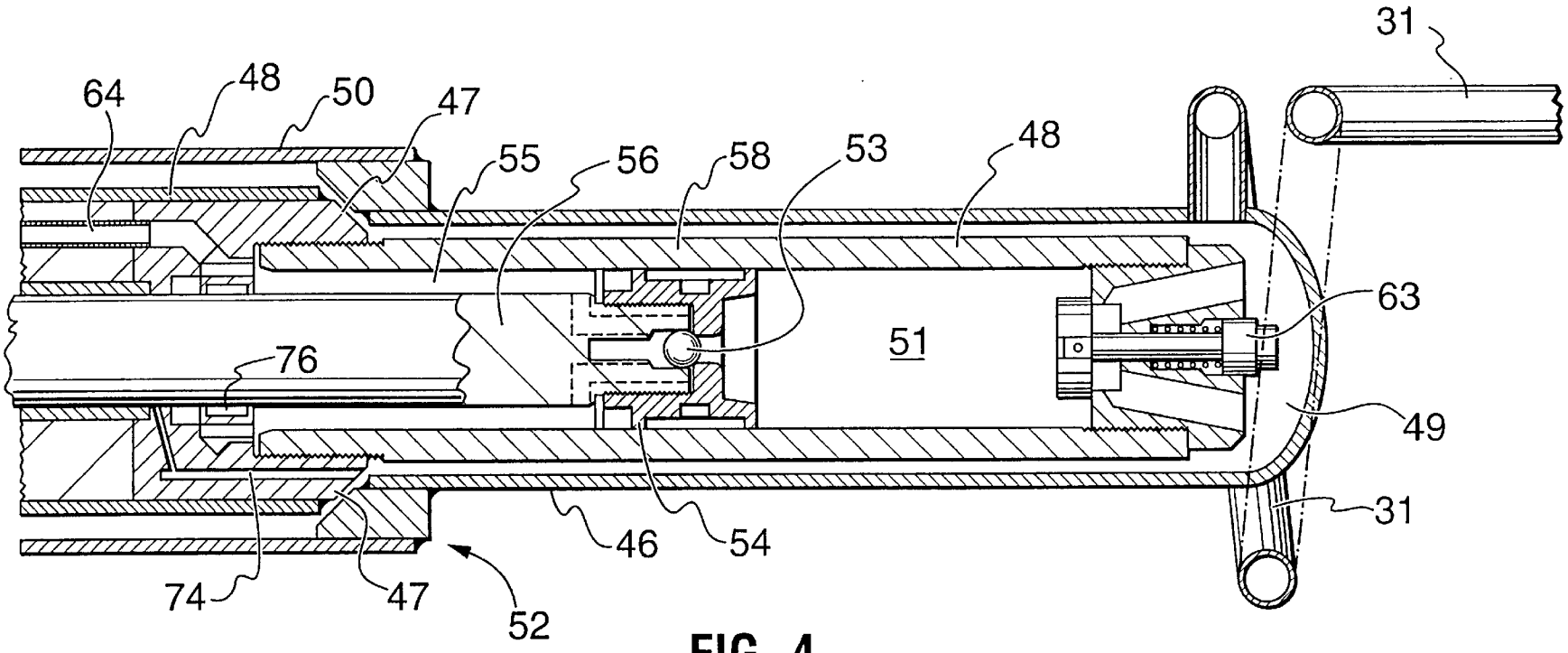
FIG. 4 illustrates a detailed enlarged section view of the second embodiment of the invention with the LNG pump built into the sump of the LNG tank.

FIG. 4 illustrates a detailed enlarged section view of the second embodiment of the invention where the LNG pump 48 is built into the LNG tank 30. FIG. 4 illustrates the suction line 31 in looped configuration to thereby provide a gas trap, as is common in the cryogenic and LNG art. The pump 48 is held in place against seal 47 formed in the end of sump 46 by bolts or some similar holding mechanism. The pump 48 can be separated from seal 47 and withdrawn by removing the securing bolts. The LNG from inner tank 42 (see FIG. 3) flows through suction line 31 into the space 49 between the sump 46 and the outer shell of pump 48. The vacuum in sump space 44 (see FIG. 3) is maintained by the exterior of sump 46 and sleeve 50. The pump 48 can be withdrawn from the interior of sleeve 50 without disturbing the vacuum in space 44 (see FIG. 6). Sump 46 is sealed to sleeve 50 at junction 52.

The built-in pump 48 operates in a manner similar to pump 2. When the piston 54 retracts to the left, LNG is drawn through line 31 into the first chamber 51 through check valve 63. When the piston 54 extends to the right, the LNG is pushed through the check valve 53 located in piston 54 and into the chamber space 55 between the cylinder 58 and piston rod 56. The diameter of the piston rod 56 is sized so the volume of chamber space 55 is about half the volume of first chamber 51. Therefore, half the volume of the liquid in chamber 51 will flow to chamber 55 and the remainder will be pushed out to the left through the outlet line 64 and one-way check valve 66 (see FIG. 3). The pressure in chambers 51 and 55 will become equal to the discharge pressure as soon as the piston 54 again starts extending to the right.

When the piston 54 retracts to the left again, more LNG will be drawn through line 31 into chamber 51 while at the same time the previously transferred LNG in chamber 55 will be discharged out through outlet line 64. In other words, on each piston stroke, in either direction, an equal amount of LNG is discharged. This is an advantage for smooth pump operation. It is also a significant advantage of this pump design that the one-way check valve (see check valve 66 in FIG. 3) can be located outside the pump 48 on outlet line 64, where it is accessible and easy to maintain. FIG. 4 also illustrates passageway 74 which enables liquid which escapes past shaft seal 76 to return to the sump 46.

Figure 5:
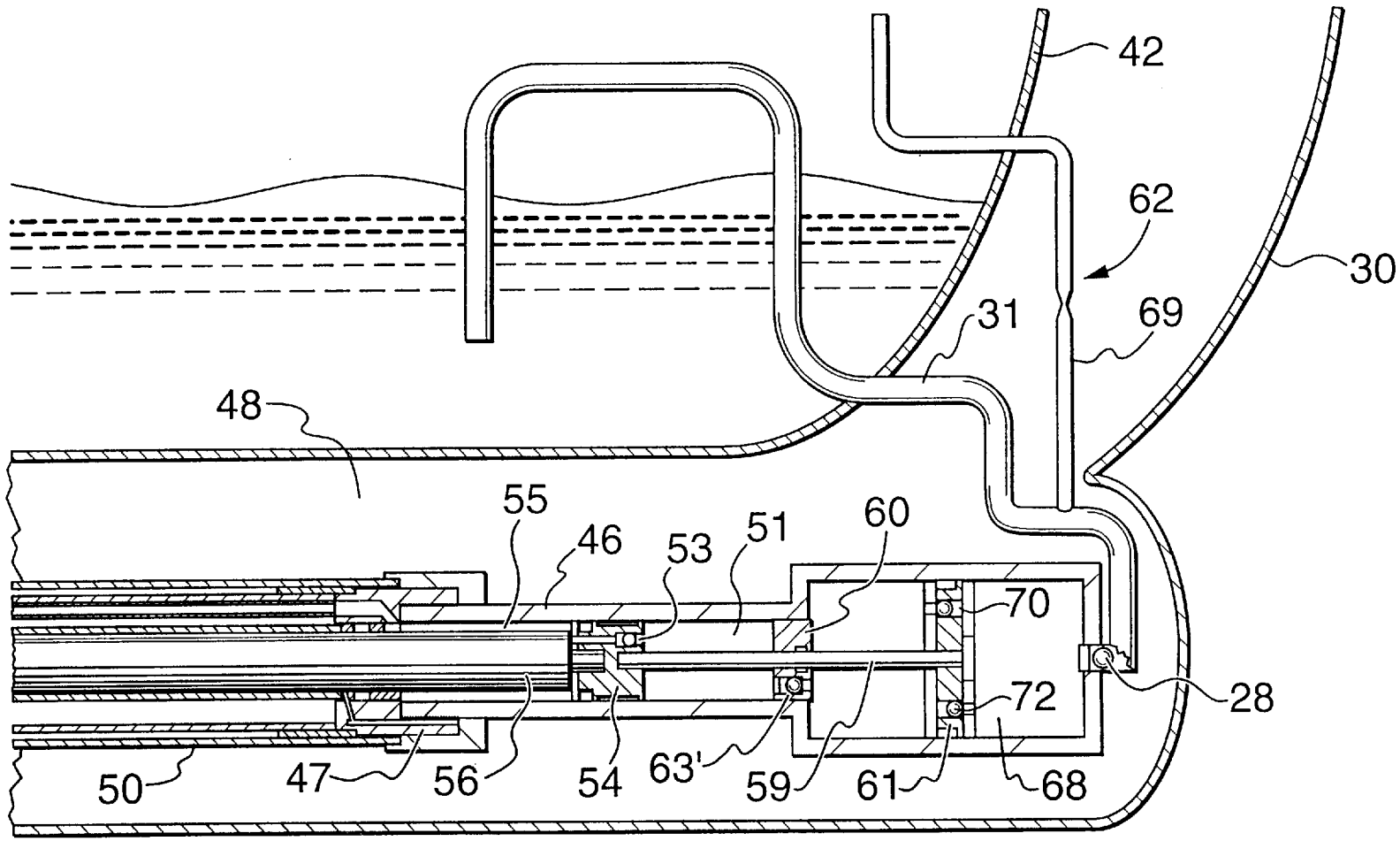
FIG. 5 illustrates a detailed enlarged section view of a third embodiment of the invention featuring the LNG pump built into the LNG tank in association with an inducer.

The pump shown in FIG. 4 will pump LNG to high pressure without inducing heat into the storage tank 30, but if operating conditions are such that a longer holding time is demanded, an inducer feature similar to that shown in FIGS. 1 and 2 can be added. FIG. 5 illustrates a detailed enlarged section view of a third embodiment of the invention featuring the LNG pump built into the LNG tank in association with an inducer. It will be understood that FIG. 5 is illustrative only and would not be built precisely as shown. The narrow left end of the sump 46 would have to be layered in order to enable the pump 48 and inducer to be withdrawn.

In the embodiment illustrated in FIG. 5, an induction chamber 68 is attached to the inlet end of the pump 48. The volume of this induction chamber 68 is on the order of four times larger than chamber 51, that is, the diameter of chamber 68 is twice that of chamber 51. A smaller piston rod 59 is extended through the first bottom plug 60 and another piston 61 is attached to the end of rod 59. This piston 61 has a pair of opposing check valves 70 and 72 which act the same way as check valves 24 and 27 in the pump 2 illustrated in FIGS. 1 and 2. A tube 69 connected to the vapour space of the tank 42 is fed through a restricting orifice 62 and then back into the main suction line 31 feeding liquid to the pump 48. This restricting orifice 62 acts the same way as the metering valve 41 acts on the pump 2 that is illustrated in FIG. 2. As before, the embodiment shown in FIG. 5, by drawing vapour as well as liquid from the tank 42, can greatly increase the holding time before boil off venting occurs. The optimum size for restriction of restriction 62 can be detained by using an adjustable orifice.

As an alternative embodiment, the induction chamber 68 illustrated in FIG. 5 can be eliminated if the ratio between the first chamber 51 and the second chamber 55 is increased to 2:1 or larger. In that case, the main suction line 31 and tube 69, with restriction 62, can be connected directly to the sump 46.

Figure 6:
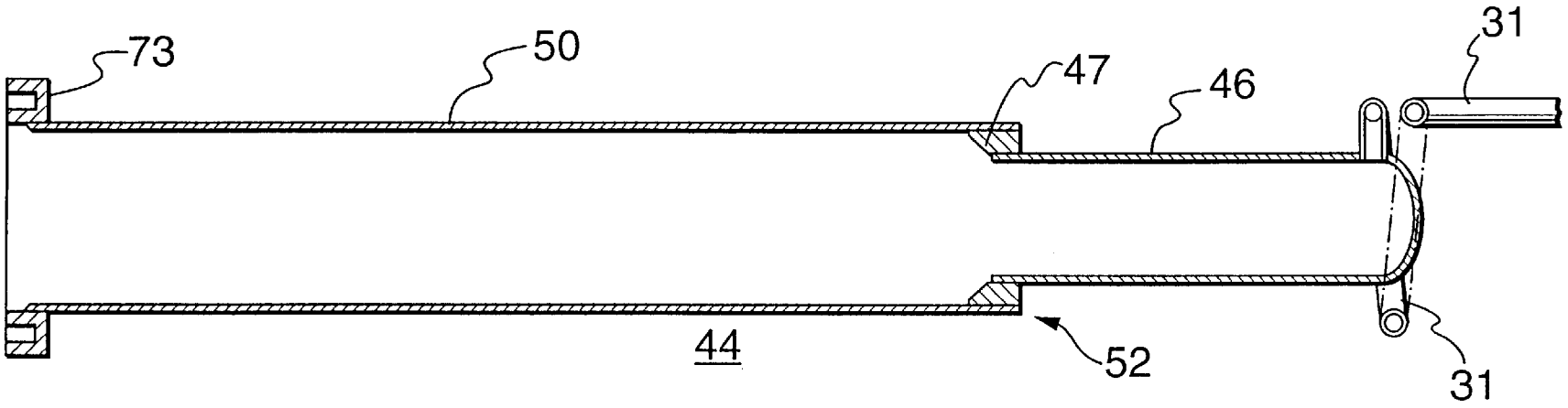
FIG. 6 illustrates a section view of the sump when the LNG pump is withdrawn from the LNG tank.

FIG. 6 illustrates a detail of the sump 46 and the sleeve 50 when the LNG pump 48 has been separated from the LNG tank. After the pump 48 has been withdrawn, the sump 46, with looped inlet 31, and the sleeve 50, still remain in place within sump space 44 to preserve the vacuum between the outer jacket 30 and inner jacket 42 of the LNG tank. The end of the sleeve 50 opposite the sump 46 is sealed to the outer jacket 30 (not shown, but see FIG. 3) at seal 73. The pressure seal 47, against which pump 48 bears, when installed inside sleeve 50 and sump 46, is also shown in FIG. 6.

The LNG pumps 2 and 48 illustrated in FIGS. 1 to 6 inclusive are small and are intended primarily for use on vehicles. It will be understood, however, that the pumps, in either configuration, can be enlarged and used in other cryogenic applications such as liquid to compressed gas fuel stations (often known as LCNG fuel stations).

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A cryogenic pump comprising:

(a) a vessel for containing compressed gas and liquid;

(b) a first chamber in said vessel with an inlet therein for receiving gas and liquid;

(c) a second chamber in said vessel communicating with said first chamber for receiving and dispelling gas and liquid;

(d) a third chamber in said vessel communicating with said second chamber for receiving and dispelling gas and liquid;

(e) a reciprocating means separating said first, second and third chambers from one another and for drawing and compressing gas and liquid in any one of the first, second and third chambers;

(f) first one-way means in the inlet for enabling gas and liquid to pass into the first chamber;

(g) second one-way means between said first chamber and said second chamber for enabling gas and liquid to pass from said first chamber to said second chamber;

(h) third one-way means for enabling gas and liquid to return from the second chamber to the first chamber;

(i) fourth one-way means between said second and third chambers for enabling gas and liquid to pass from said second chamber to said third chamber; and (j) fifth one-way means for enabling gas and liquid to be expelled from said third chamber to the exterior of the vessel.

2. A pump as claimed in claim 1 wherein said vessel is a hollow first cylinder, said reciprocating pumping means is a piston which reciprocates longitudinally within the interior of the cylinder, said reciprocating means being reciprocally driven by a longitudinally extending shaft connecting the reciprocating means with an exterior reciprocating power source.

3. A pump as claimed in claim 2 wherein the reciprocating piston and shaft is driven by a hydraulic cylinder.

4. A pump as claimed in claim 2 wherein said reciprocating piston has thereon a hollow rod which extends from a side of the piston opposite the longitudinally extending shaft, said hollow rod reciprocating in a second hollow cylinder which is positioned in the interior of the first cylinder, said hollow rod connecting the second chamber and the third chamber, the third chamber being located in the interior of the second hollow cylinder.

5. A pump as claimed in claim 4 wherein the inlet to the first chamber of the vessel is connected to a liquified natural gas holding tank by a hollow inlet line, the hollow inlet of the inlet line being located below the surface of liquid in the liquified natural gas holding tank.

6. A pump as claimed in claim 5 including a hollow gas line which is connected from a gas vapour region of the liquified natural gas holding tank to the hollow liquid inlet line.

7. A pump as claimed in claim 6 wherein a control valve and a metering valve are located in the hollow gas line connecting the gas vapour region of the liquified natural gas holding tank with the hollow liquid inlet line.

8. A pump as claimed in claim 5 wherein the liquified natural gas holding tank comprises a sealed inner jacket and a sealed outer jacket, and the space between the inner jacket and the outer jacket has a heat insulating vacuum therein.

9. A pump as claimed in claim 4 wherein the exterior of the pump is insulated and heat insulation is positioned between the shaft and the first cylinder and between the first cylinder and the second cylinder.

10. A pump as claimed in claim 1 wherein the second one-way means between the first chamber and the second chamber is a check valve which is located in the reciprocating piston, and the fourth one-way means connecting the second chamber with the third chamber is a check valve which is located in the hollow rod extending from the reciprocating piston.

11. A pump as claimed in claim 1 wherein the first one-way means is a check valve and the fifth one-way means connecting the interior of the third chamber with the exterior of the vessel is a check valve.

12. A pump as claimed in claim 1 wherein the third one-way means is a liquid pressure relief check valve which is located in the reciprocating piston, and is set to open at a predetermined pressure and thereby enable gas and liquid in said second chamber to return to said first chamber.

13. A pump as claimed in claim 1 wherein the outlet of the third chamber of the pump is connected to a vapourizer, which is sequentially connected to a gas accumulator, which is sequentially connected to an internal combustion engine.

14. A pump as claimed in claim 13 wherein when the gas pressure in the accumulator drops to a specified level, the control valve closes so that the first chamber of the vessel receives only liquid from the hollow liquid inlet line.

15. A pump as claimed in claim 14 including a hollow gas line connected between the second chamber of the vessel and the gas vapour region of the liquified natural gas holding tank, said gas line having a control valve therein, said control valve opening under predetermined conditions to enable gas from said second chamber to be transferred to said gas vapour region of said holding tank.

16. A cryogenic pump comprising:

(a) a vessel for containing compressed gas and liquid;

(b) a sump with an inlet therein for receiving gas and liquid, said sump being connectable to a source of gas and liquid;

(c) a first chamber in the vessel communicating with said sump for receiving gas and liquid from the sump;

(d) first one-way inlet means between the sump and the first chamber for enabling gas and liquid to pass into the first chamber;

(e) a second chamber in the vessel communicating with said first chamber for receiving and dispelling gas and liquid;

(f) a reciprocating piston separating said first chamber and said second chamber from one another and for drawing and compressing gas and liquid in any one of the first and second chambers;

(g) second one-way means in the reciprocating piston between said first and second chambers for enabling gas and liquid to pass from said first chamber to said second chamber; and (h) means for enabling gas and liquid to be expelled from said second chamber to the exterior of the vessel.

17. A pump as claimed in claim 16 wherein said first and second chambers are cylindrical and releasably fit within the sump which is a hollow cylinder, and are in longitudinal alignment with one another, said reciprocating pumping means is a piston which reciprocates longitudinally within the interior of the first and second cylindrical chambers, said reciprocating piston being reciprocally driven by a longitudinally extending shaft connecting the reciprocating piston with an exterior reciprocating energy source, and said second chamber is an annular shaped volume between the exterior of the shaft and the interior of the cylindrical vessel.

18. A pump as claimed in claim 17 including a seal between the longitudinally extending shaft and the second chamber, and a passage circumventing the seal for enabling liquid that escapes past the seal to be returned to the sump.

19. A pump as claimed in claim 17 wherein said second hollow annular volume is connected to a hollow line which extends to the exterior of the vessel, opposite to the sump inlet.

20. A pump as claimed in claim 19 wherein the second one-way means between the first chamber and the second chamber is a check valve which is located in the reciprocating piston.

21. A pump as claimed in claim 16 wherein the first one-way inlet means is a check valve.

22. A pump as claimed in claim 16 wherein the means connecting the second chamber with the exterior of the vessel is a pipe and a check valve which is located to the exterior of the pump.

23. A pump as claimed in claim 16 wherein the outer jacket has therein a region in which the pump can be installed between the inner jacket and the outer jacket.

24. A pump as claimed in claim 23 wherein the pump fits within a sump in the region between the inner jacket and the outer jacket, an inlet from the holding tank to the pump is connected to the sump within the interior between the inner jacket and the outer jacket, and an outlet from the pump extends to the exterior of the holding tank.

25. A pump as claimed in claim 24 wherein the pump located between the inner and outer jackets of the holding tank includes an inducer which contains therein a second reciprocating piston which is connected to the first reciprocating piston, said second reciprocating piston in said inducer separating the interior of the inducer into third and fourth chambers, said third and fourth chambers being interconnected by a check valve, a relief valve, said third chamber being connected to said first chamber by a check valve, and said fourth chamber being connected to said inlet line from said holding tank by a check valve.

26. A pump as claimed in claim 25 wherein the inlet line to the fourth chamber of the inducer includes a hollow gas vapour line which connects the inlet line with the gas vapour region of the holding tank, said hollow gas vapour line having therein a restriction which regulates the flow of gas through the gas vapour inlet line.

27. A pump as claimed in claim 16 wherein the first chamber is at least twice as large in volume as the second chamber.

* * * * *